US006307313B1

(12) United States Patent
Fukuda

(10) Patent No.: US 6,307,313 B1
(45) Date of Patent: Oct. 23, 2001

(54) CATHODE RAY TUBE APPARATUS

(75) Inventor: Yutaka Fukuda, Kumagaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/280,062

(22) Filed: Mar. 29, 1999

(30) Foreign Application Priority Data

Mar. 31, 1998 (JP) ..... 10-086240

(51) Int. Cl.[7] ..... H01J 29/70
(52) U.S. Cl. ..... 313/421; 313/440
(58) Field of Search ..... 313/440, 461, 313/463, 476, 477 R, 481, 482, 421

(56) References Cited

U.S. PATENT DOCUMENTS 3,731,129 5/1973 Tsuneta et al. ..... 313/64
4,754,190 * 6/1988 Hinotami et al. ..... 313/422
5,155,411 * 10/1992 Swank et al. ..... 313/477 R
5,319,280 * 6/1994 Vriens ..... 313/413
5,962,964 * 10/1999 Sano et al. ..... 313/440
6,002,203 * 12/1999 Yokota et al. ..... 313/477

FOREIGN PATENT DOCUMENTS 6-168676 6/1994 (JP) .
10-83775 3/1998 (JP) .

* cited by examiner

*Primary Examiner*—Michael H. Day
*Assistant Examiner*—Matthew J. Gerike
(74) *Attorney, Agent, or Firm*—Pillsbury Winthrop LLP

(57) ABSTRACT

A yoke portion with a deflection coil mounted thereon has a rectangular section perpendicular to the tube axis. A horizontal deflection coil of the deflection coil is formed of a loop winding including a pair of parallel portions extending along the both sides of the tube axis and crossover portions connecting the parallel portions. The crossover portion nearer to the neck is formed of a winding wound in the direction along the tube axis.

6 Claims, 6 Drawing Sheets

CATHODE RAY TUBE APPARATUS

BACKGROUND OF THE INVENTION

The present invention relates to a cathode ray tube apparatus, or more in particular, to a cathode ray tube apparatus comprising a deflection yoke capable of reducing the deflection power and the leakage magnetic field effectively.

Generally, the cathode ray tube apparatus comprises a vacuum envelope of glass and a deflection yoke forming a deflection magnetic field for deflecting the electron beams. The vacuum envelope includes a rectangular faceplate, a cylindrical neck portion and a funnel portion for coupling the faceplate and the neck portion to each other. The deflection yoke is mounted over the portion extending from the neck portion to the yoke portion in the funnel portion.

In the cathode ray tube apparatus having this construction, the deflection power supplied to the deflection yoke is the main power consumed in the apparatus. In recent years, in order to satisfy the requirement for high brightness and high definition of the cathode ray tube apparatus, the trend is toward an even more increased deflection power. For the power consumption of the cathode ray tube apparatus to be reduced, however, the deflection power is required to be decreased.

Generally, for reducing the deflection power, the outer diameters of the neck portion and the yoke portion are desirably reduced. With this structure, the operating space of the deflection magnetic field is reduced and the operating efficiency of the deflection magnetic field exerted on the electron beams is improved.

In the conventional cathode ray tube apparatus, however, if the outer diameters of the neck portion and the yoke portion are reduced, the electron beam having a large deflection angle, that is, having an electron beam trajectory at a large angle to the tube axis impinges on the inner wall of the yoke portion. Such an electron beam fails to reach the phosphor screen and causes a display failure. In the cathode ray tube apparatus having this construction, it is difficult to reduce the deflection power and the leakage magnetic field by reducing the outer diameters of the neck portion and the yoke portion.

U.S. Pat. No. 3,731,129 discloses a cathode ray tube in which the shape of a section perpendicular to the tube axis of the yoke portion changes progressively from a circle to a rectangle starting with the neck portion toward the faceplate in approximation with the passage area of the electron beam. With this pyramidal yoke portion, the outer diameter of the yoke portion can be reduced while preventing the electron beam from impinging on the inner wall of the yoke portion. Also, with this structure, the deflection magnetic field acts on the electron beam with a comparatively high efficiency.

In the cathode ray tube apparatus of this configuration, however, the side surfaces of the yoke portion flatten more and the environmental pressure resistance of the yoke portion of the vacuum envelope is reduced more, the higher the rectangularity of the sectional shape of the yoke portion. Thus the safety is adversely affected.

Recently, a flat display unit with a flat outer surface of the faceplate has found an application. In the flat display unit with an outer surface having a radius of curvature at least twice the effective diagonal length of the phosphor screen (the faceplate is completely flat when the radius of curvature is infinitely large), however, the environmental pressure resistance of the faceplate is low and the yoke portion, if pyramidal, decreases also in the environmental pressure resistance, thereby making it difficult to secure a mechanical strength required of the vacuum envelope as a whole for safety. The strength of the vacuum envelope, that is, the environmental pressure resistance and the mechanical strength thereof combined will hereinafter be collectively called the bulb strength.

FIG. 10A shows a structure in which a conical deflection yoke 105 is mounted on a yoke portion 103 of the cathode ray tube disclosed in U.S. Pat. No. 3,731,129. FIG. 10B shows a horizontal deflection magnetic field distribution MF1 formed by the deflection yoke 105. In this deflection magnetic field distribution MF1, a position of the deflection center where the deflection magnetic field is most concentrated is called C.

As shown in FIG. 10C, in the case where the yoke portion 201 is formed substantially pyramidal and the deflection yoke 202 is formed in conformance with the outline of the yoke portion 201, the distance D2 between the inner surface at the end portion 203*a* of the horizontal deflection coil 203 nearer to the screen and the tube axis Z is smaller than the distance D1 of the horizontal deflection coil 110 shown in FIG. 10A, and therefore the electron beams become nearer. In this case, the position of the deflection center of the horizontal deflection magnetic field distribution MF2 shifts toward the screen from point C, as shown in FIG. 10D.

FIG. 11 is a diagram for explaining the trilemma indicating the degree of misconvergence. In the case where rectangular rasters 204 and 205 are plotted by a pair of side beams on the phosphor screen, the trilemma Tr is expressed as XH−YH+PQV. In the case where the rasters 204 and 205 completely coincide with each other, that is, in the case where Tr=0, it is assumed to be a reference state. As shown in FIGS. 10C and 10D, when the position of the deflection center of the horizontal deflection magnetic field distribution MF2 shifts toward the screen from point C, the trilemma Tr increases in positive direction from the reference state and deteriorates the convergence characteristic.

A method of correcting the deterioration of the convergence characteristic may be to move the end portion 203*a* of the horizontal deflection coil 203 nearer to the screen back toward the neck along the tube axis Z. This method, however, has the disadvantage of reducing the deflection sensitivity.

Another method may be to extend the end portion of the horizontal deflection coil 203 nearer to the neck toward the neck along the tube axis Z. The horizontal deflection coil 203 shown in FIG. 10C has what is called a bend-up type of end portion, in which, with the increase in the number of turns, the crossover portion 206 near to the neck is wound progressively in the direction away from the tube axis Z, that is, in radial direction of a circle having the tube axis as a center axis. With the horizontal deflection coil 203 having this structure, the magnetic field leaking toward the neck is strong. As a result, the end portion of the horizontal deflection coil 203 is required to be extended more toward the neck along the tube axis Z. This is structurally difficult to realize.

In the conventional cathode ray tube apparatus, the two requirements described above, that is, a rectangular section of the yoke portion in order to sufficiently reduce the deflection power and a sufficient bulb strength even with a rectangular section of the yoke portion on the other, cannot be met at the same time. It is especially difficult for the cathode ray tube apparatus for flat display to reduce the deflection power and to secure a sufficient bulb strength at the same time.

Also, in the conventional cathode ray tube apparatus, if the deflection yoke is used which simply conforms with the outline of the substantially pyramidal yoke portion without taking the magnetic field leaking toward the neck into consideration, the problem of a deteriorated convergence is posed.

BRIEF SUMMARY OF THE INVENTION

The present invention has been developed to solve the above-mentioned problem and the object thereof is to provide a cathode ray tube apparatus, in which a sufficient bulb strength can be secured while reducing the deflection power and preventing the deterioration of the convergence characteristic, and in which the requirement for both high brightness and high definition can be met.

According to the present invention, there is provided a cathode ray tube apparatus comprising:

a vacuum envelope including a faceplate having on the inner surface thereof a substantially rectangular phosphor screen having an aspect ratio M:N between the length along a horizontal axis perpendicular to a tube axis and the length along a vertical axis perpendicular to the tube axis and the horizontal axis, a cylindrical neck portion having an electron gun assembly built therein for emitting electron beams in the direction along the tube axis, a funnel portion for connecting the faceplate and the neck portion, and a yoke portion of which a section perpendicular to the tube axis on the neck portion side of the funnel portion changes in shape from a circle of the same diameter as the neck portion to a non-circle having a maximum diameter in other than the directions along the horizontal axis and the vertical axis; and a deflection yoke mounted on the outer surface of the vacuum envelope and extending from the neck portion to the yoke portion for forming a deflection magnetic field for deflecting the electron beams;

wherein at least one section of the yoke portion perpendicular to the tube axis is a non-circle having a maximum outer diameter in a direction other than along the vertical axis and the horizontal axis, assuming that the distance between the tube axis and the outer surface of the yoke portion is the outer diameter of the yoke portion;

wherein the deflection yoke includes a cylindrical core portion formed of a magnetic material surrounding at least one of a horizontal deflection coil and a vertical deflection coil for forming the deflection magnetic field;

wherein at least one section of the core portion perpendicular to the tube axis is a non-circle having a maximum inner diameter in a direction other than along the vertical axis and the horizontal axis, assuming that the distance between the tube axis and the inner surface of the core portion is the inner diameter; and wherein the horizontal deflection coil is formed of a loop-like winding including a pair of parallel portions extending along the both sides of the tube axis and crossover portions connecting the parallel portions, and the crossover portion nearer to the neck is formed of a winding arranged and wound in a direction along the tube axis.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A cathode ray tube apparatus and a deflection yoke according to an embodiment of the present invention will be described in detail below with reference to the drawings.

The invention provides a cathode ray tube apparatus comprising a vacuum envelope including a yoke portion having an optimum shape capable of reducing the deflection power and securing a sufficient bulb strength at the same time even when the yoke portion of the vacuum envelope has a pyramidal shape, and a deflection yoke of an optimum shape mounted on the yoke portion capable of preventing the deterioration of the convergence characteristic.

Figure 1:
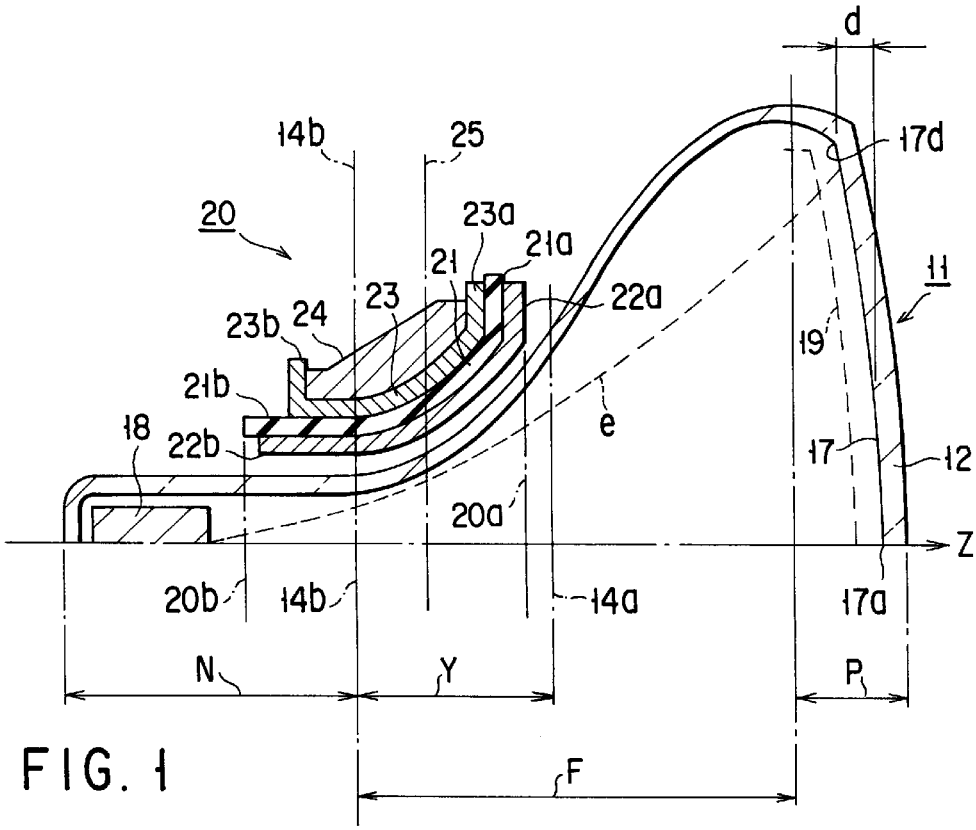
FIG. 1 is a partial sectional view schematically showing, in a section containing the tube axis, a configuration of a cathode ray tube apparatus according to the invention.
Figure 2:
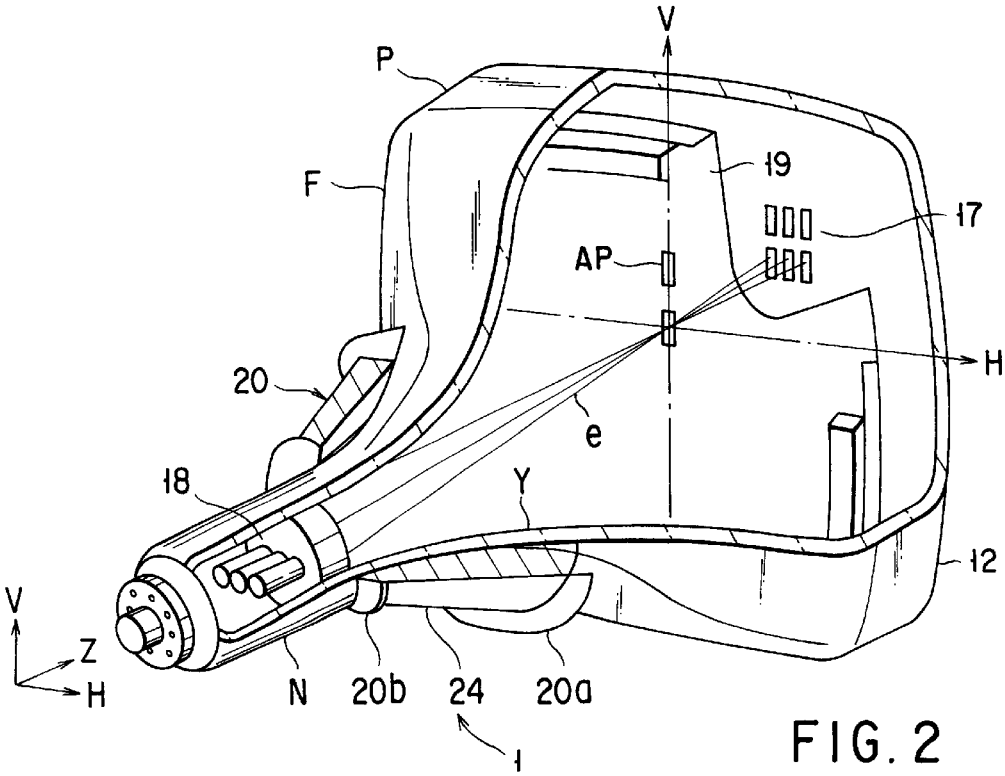
FIG. 2 is a partial sectional view schematically showing the outer appearance and the internal structure of the cathode ray tube apparatus of FIG. 1.

As shown in FIGS. 1 and 2, a cathode ray tube apparatus 1 comprises a vacuum envelope 11 of glass and a deflection yoke 20 forming a deflection magnetic field for deflecting the electron beam. The vacuum envelope 11 includes a faceplate P having a substantially rectangular effective faceplate surface 12, a cylindrical neck portion N having a center axis coincident with the tube axis and a funnel portion F for coupling the faceplate P and the neck portion N to each other. The funnel portion F includes, on the neck portion N side thereof, a yoke portion Y having the deflection yoke 20 mounted thereon.

The faceplate P includes on the inner surface thereof a phosphor screen 17 having striped or dotted three-color phosphor layers for emitting red, green and blue light, respectively. In this case, the flatness of the faceplate P is defined by the radius of curvature of the outline of the faceplate P approximated to a circle. Specifically, the radius of curvature of the faceplate P is determined by approximation of a circle based on a head d toward the neck portion N along the tube axis Z at a diagonal end 17*d* between the center 17*a* of the phosphor screen and the diagonal end 17*d*. According to this embodiment, the flatness in terms of radius of curvature of the faceplate P is more than twice the effective diagonal length of the effective faceplate 12. In the case where the radius of curvature is infinitely large, it indicates that the outer surface of the faceplate P is completely flat. In other words, this invention is applicable to what is called the flat display unit having a faceplate P having a substantially flat outer surface.

The faceplate P includes a shadow mask 19 arranged in spaced and opposed relation to the phosphor screen 17. This shadow mask 19 has on the inner surface thereof a multiplicity of apertures AP for passing the electron beams.

The neck portion N includes therein an electron gun assembly 18 for emitting three electron beams e aligned and passing in the same horizontal plane, that is, what is called the in-line electron gun assembly.

The three electron beams e are aligned along the horizontal axis H and emitted along the direction parallel to the tube axis Z. Of the three electron beams, the electron beam constituting the center beam proceeds along the trajectory nearest to the center axis of the neck portion N. The electron beams constituting a pair of side beams proceed along the trajectories on the both sides of the center beam.

The electron gun assembly 18 converges the three electron beams e toward the phosphor screen 17 while at the same time focusing each of the three electron beams e on the phosphor screen 17.

Figure 3:
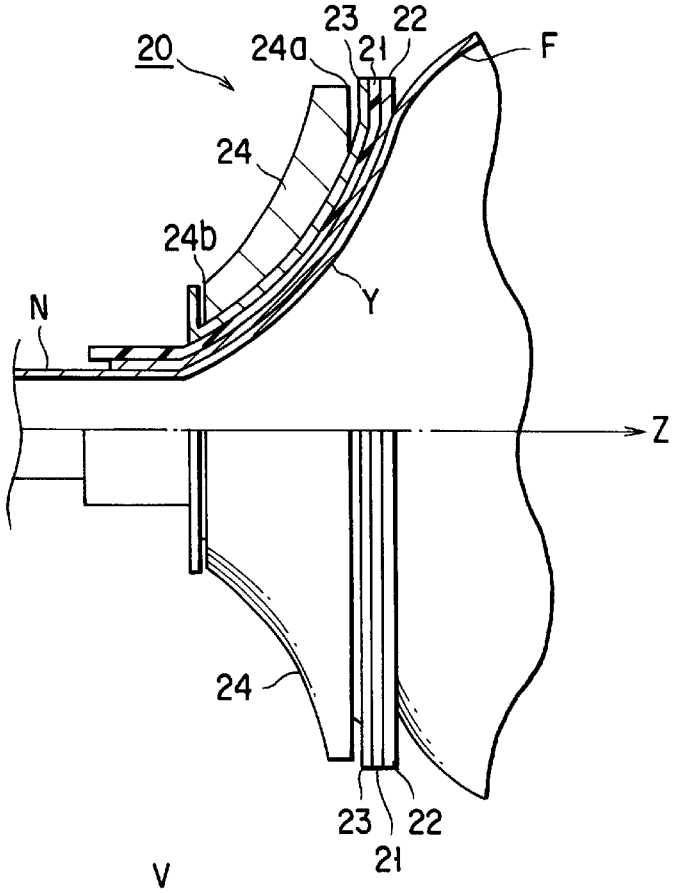
FIG. 3 is a partial sectional view schematically showing the outer appearance and the internal structure of the yoke portion of the cathode ray tube apparatus shown in FIG. 1.

The deflection yoke 20, as shown in FIG. 3, includes a horizontal deflection coil 22 for forming a horizontal deflection magnetic field in pin-cushion form, a vertical deflection coil 23 for forming a vertical deflection magnetic field in barrel form, a cylindrical separator 21 interposed between the horizontal deflection coil 22 and the vertical deflection coil 23, and a cylindrical core portion 24 made of a magnetic material of high permeability. The deflection yoke 20 forms a non-uniform deflection magnetic field for deflecting the electron beam by the horizontal deflection coil 22 and the vertical deflection coil 23.

The separator 21 is formed of a synthetic resin or plastics in the shape of a horn having an aperture size on the neck portion N side thereof smaller than the aperture size on the faceplate P side thereof. The separator 21, in the section containing the tube axis Z as shown in FIG. 1, includes a end portion nearer to the screen along the tube axis Z, that is, a flange 21*a* and an end portion nearer to the neck portion, that is, a cylindrical portion 21*b*.

Figure 9:
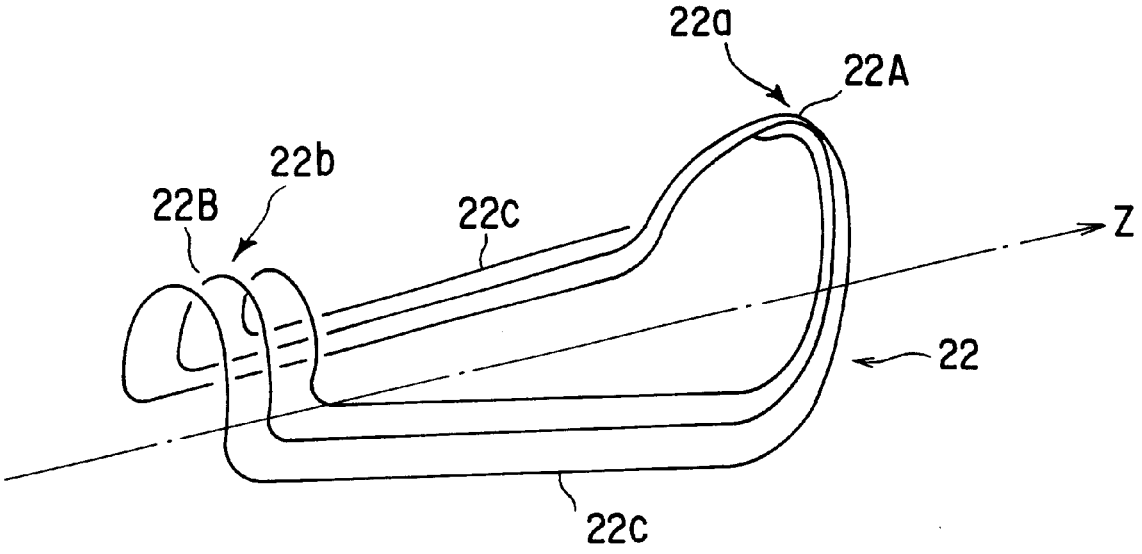
FIG. 9 is a perspective view schematically showing the structure of the horizontal deflection coil of the deflection yoke used with the cathode ray tube apparatus according to this invention.

The horizontal deflection coil 22 is of saddle type, and includes a bend portion 22*a* nearer to the screen along the tube axis Z and a bendless portion 22*b* nearer the neck portion. This bendless portion 22*b* is formed in such a manner as not to protrude substantially radially from the cylindrical surface with the tube axis Z as a center axis. In other words, as shown in FIG. 9, the winding 22B forming the bendless portion 22*b* of the horizontal deflection coil 22 is wound in the direction along the tube axis Z in such a manner as not overlap radially away from the tube axis Z. Preferably, the bendless portion 22*b* of the horizontal deflection coil 22 is configured of a single winding layer along the outer surface of the neck portion N. This horizontal deflection coil 22 is fixed in grooves formed in the inner wall of the separator 21.

The vertical deflection coil 23 is of saddle type, and includes an end portion nearer to the screen along the tube axis Z, that is, a bend portion 23*a*, and an end portion nearer to the neck portion, that is, a bend portion 23*b*. This vertical deflection coil 23 is fixed on the outer wall of the separator 21.

The magnetic field leaking from the deflection yoke 20 can be reduced by combining the saddle-type horizontal deflection coil 22 and the saddle-type vertical deflection coil 23 with each other and thus by reducing the diameter of the coil nearer to the screen.

The core portion 24 is fixedly arranged around the outer periphery of the horizontal deflection coil 22 and the vertical deflection coil 23 and constitutes the magnetic core of the deflection magnetic field.

In the cathode ray tube apparatus having this structure, the three electron beams e emitted from the electron gun assembly 18 are deflected while being self-converged by the non-uniform deflection magnetic field generated by the deflection yoke 20. Specifically, the three electron beams e scan the phosphor screen 17 in the directions of the horizontal axis H and the vertical axis V, respectively, through the shadow mask 19. As a result, a color image is displayed.

As shown in FIG. 1, the outline of the funnel portion F along the tube axis Z is formed substantially in a S-shaped curve from the faceplate P to the neck portion N. Specifically, the funnel portion F is formed convex on the faceplate P side thereof, and concave on the neck portion N side of the yoke portion The boundary 14*a* on the faceplate side of the yoke portion Y is the inflection point of the S-shaped curve. The boundary 14*b* on the neck portion N side of the yoke portion Y is a junction with the neck portion N. The deflection yoke 20 is mounted in such a position that the end portion 20*a* on the faceplate side thereof is located in the neighborhood of the boundary 14*a*. The end portion 20*b* on the neck portion side of the deflection yoke 20 is located on the side of the boundary 14*b* nearer the neck portion. A deflection reference point 25 is located in the range of the yoke portion Y.

Figure 5A:
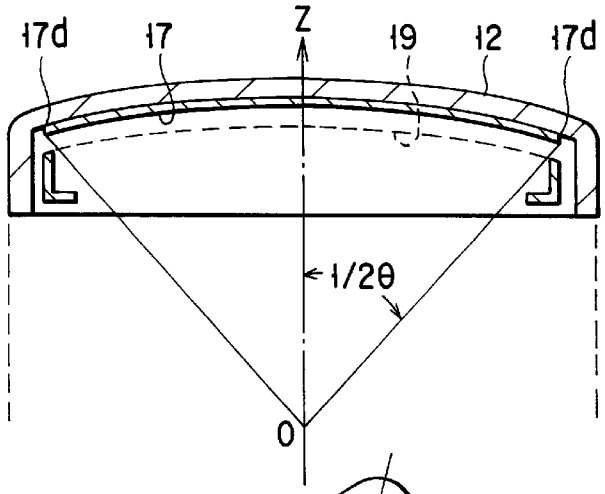
FIG. 5A is a sectional view, cut away along the diagonal of the faceplate, of the cathode ray tube shown in FIG. 1.
Figure 5B:
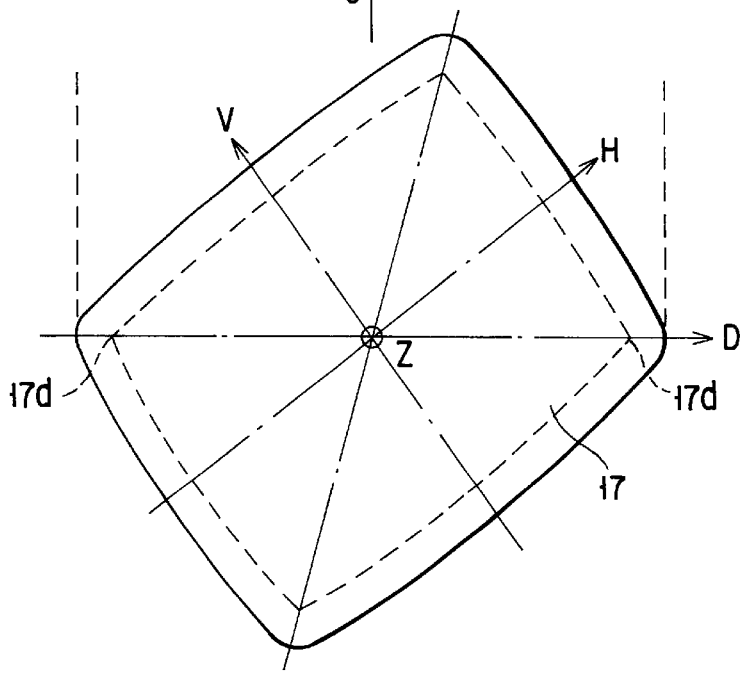
FIG. 5B is a plan view of the faceplate of the cathode ray tube apparatus shown in FIG. 1.

The deflection reference point 25 is defined as follows. As shown in FIGS. 5A and 5B, draw two lines connecting the ends 17*d* of the screen diagonals on both sides of the tube axis Z and a given point 0 on the tube axis Z. The deflection reference point 25 is defined as the point 0 on the tube axis where the angle formed by the two lines is equivalent to a maximum deflection angle θ according to the specification of the cathode ray tube apparatus. This deflection reference point 25 constitutes the deflection center about which the electron beam is deflected.

Figure 4:
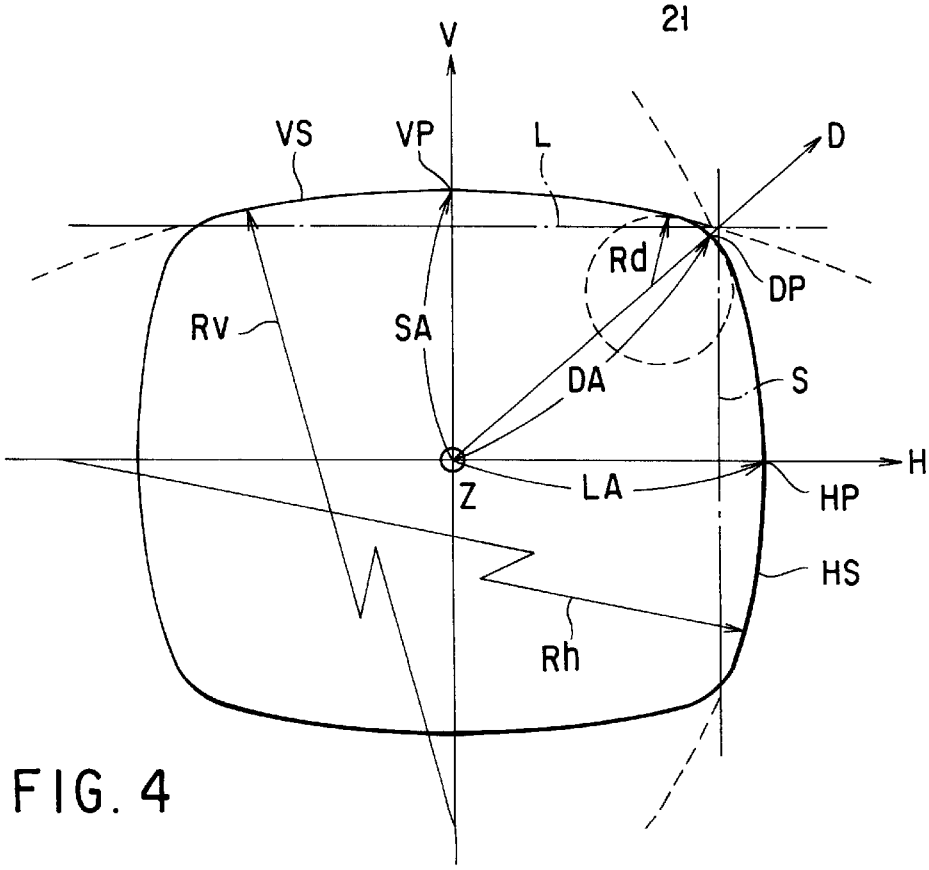
FIG. 4 is a sectional view, cut away perpendicular to the tube axis, schematically showing the outline of the yoke portion of the cathode ray tube apparatus shown in FIG. 1.

As shown in FIG. 4, the sectional shape of the outline of the yoke portion perpendicular to the tube axis at the deflection reference point 25 is not circular. Specifically, let HP an intersection between the horizontal axis H and the outline of the yoke portion, VP an intersection between the vertical axis V and the outline of the yoke portion, and DP an intersection between the diagonal axis D and the outline of the yoke portion. Also, let LA be the distance from the tube axis Z to the intersection HP, SA be the distance from the tube axis Z to the intersection VP, and DA be the distance from the tube axis Z to the intersection DP.

Then, the outline of the yoke portion is a non-circle in which an outer diameter in a direction other than the horizontal axis H and the vertical axis V assumes a maximum value. The sectional shape of the outline of the yoke portion shown in FIG. 4 is a substantial rectangle in which LA and SA are smaller than DA, and DA assumes the largest value.

In the cathode ray tube apparatus having the yoke portion of this shape, therefore, the deflection coils arranged in the neighborhood of the intersections HP and VP can be located near to the electron beams, and therefore the operating efficiency of the deflection magnetic field exerted on the electron beams can be improved. As a result, the deflection power can be reduced. Also, the coil diameter of the portion nearer to the faceplate and the bend portions 22*a*, 23*a* can be reduced for a decreased leakage magnetic field.

As far as the example shown in FIG. 4 is concerned, the diameter along the diagonal axis D is largest of all. However, the diameter along the diagonal axis D is not always largest of all.

In the sectional shape of the outline of the yoke portion, the main surface VS crossing the vertical axis V is formed in an arc with a radius of curvature Rv having the center on the vertical axis V. The main surface HS crossing the horizontal axis H is formed as an arc with a radius of curvature Rh having the center on the horizontal axis H. Further, the outline of the yoke portion in the neighborhood of the intersection DP is an arc and has a radius of curvature Rd with the center thereof on the diagonal axis D. The outline of the yoke portion is shaped by connecting these arcs. These surface outlines can alternatively be defined using other various formulas. In this way, the outline of the yoke portion is a non-circle which is never recessed toward the tube axis from the long side L and the short side S of the rectangle. In the example shown in FIG. 4, the outline of the yoke portion has a barrel-shaped section and is substantially formed in a pyramid.

The higher the rectangularity of the sectional shape of the yoke portion, the greater the deterioration of the bulb strength of the vacuum envelope, although the deflection power and the leakage magnetic field can be reduced more. An index of the rectangularity of the sectional shape is defined as $$X=(LA+SA)/(2DA)$$

In the case where the outline of the yoke portion is a cone having a circular section, LA and SA are equal to DA, and therefore the index X is 1. In the case where the outline of the yoke portion is a pyramid having a rectangular section, DA is the same as that of the cone for securing a margin between the outermost electron beam trajectory and the inner wall of the yoke portion. LA and SA, however, are smaller than for the cone. In other words, LA and SA are smaller than DA and therefore the index is smaller than 1.

In the case where the outline of the yoke portion is a perfect pyramid, let the aspect ratio of the rectangular section (ratio between the length along the horizontal axis and the length along the vertical axis) be M:N. Then, the index X is given as $$=(M+N)/(2*(M^2+N^2)^{1/2})$$

This index is the result of reducing the outer diameters in horizontal and vertical directions for converting the outline of the yoke portion into a rectangle. Nevertheless, the simulation analysis shows that the deflection power can be reduced in substantially similar fashion also when the outline of the yoke portion is reduced only in the horizontal or vertical direction. Therefore, emphasis on LA or SA alone is not required.

Analysis was also made as to a point on the tube axis from which the outline of the yoke portion starts to be rectangular to assure a maximum effect. As a result, it was discovered that it is important to form a rectangle of the portion extending from about the deflection reference point 25 to the end portion 20*a* on the screen side of the deflection yoke 20.

FIG. 1 shows an example trajectory of an electron beam e deflected toward the diagonal end 17*d* of the phosphor screen by the deflection magnetic field. As the center of the deflection magnetic field approaches the neck portion from the deflection reference point 25, the deflection magnetic field on the neck portion side is strengthened, so that the electron beam e is deflected more toward the neck portion side. As a result, the electron beam e deflected toward the diagonal end 17*d* impinges on the inner wall of the yoke portion. However, in the case where the outline of the yoke portion is a pyramid having a rectangular section, the center of the deflection magnetic field shifts toward the screen as seen from the deflection reference point 25. The margin between the electron beam e and the inner wall of the yoke portion increases. Consequently, the end portion 20*b* of the deflection yoke on the neck portion side thereof can be extended and thus the deflection power can be further reduced.

Also with a cathode ray tube apparatus having an outer diameter different from that of the neck portion described above, the shape of the yoke portion, though different up to about the deflection reference point 25, is substantially the same on the screen side from the deflection reference point 25. Therefore, analysis may generally reaches the same result.

Now, an explanation will be given of the reduction in deflection power.

Figure 6:
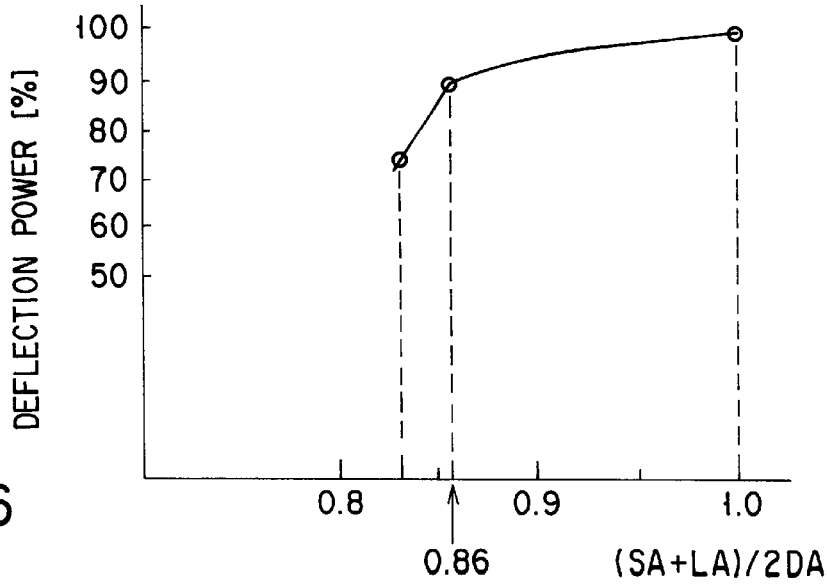
FIG. 6 is a diagram showing the relation between the flatness of the yoke portion and the deflection power of the cathode ray tube apparatus.

FIG. 6 shows the result of simulation of the deflection power with respect to the rectangularity index X.

This simulation assumes that the specification of the deflection yoke is fixed and that the deflection coils 22, 23 and the core portion 24 are located nearer to the electron beam by the increase in the rectangularity of the yoke portion. The deflection power is the horizontal one supplied to the horizontal deflection coil 22. The deflection power for deflecting the electron beam e at a predetermined deflection rate in a cathode ray tube apparatus having the index X of 1 is assumed to be 100%.

As shown in FIG. 6, when the index X decreases below 0.86 approximately, the deflection power begins to suddenly decrease. Specifically, in the case where the electron beam e is deflected at a predetermined deflection rate, the deflection power can be reduced by about 10 to 30% as compared with a conical yoke portion (X=1). For the index X of 0.86 or more, in contrast, the deflection power cannot be reduced by more than 10%.

To summarize, by making the yoke portion of the vacuum envelope of a substantial pyramid meeting the following conditions, the deflection power can be reduced while at the same time securing the bulb strength. Specifically, assume that when the aspect ratio of a substantially rectangular phosphor screen is M:N, the aspect ratio of the rectangular section of the pyramidal yoke portion substantially coincides with the aspect ratio of the phosphor screen, and that the aspect ratio of the yoke portion section is regarded as M:N. Also, a section perpendicular to the tube axis at the deflection reference point 25 is assumed to have a shape satisfying the relation $$(M+N)/(2*(M^2+N^2)^{1/2}<(SA+LA)/(2DA)\leqq 0.86$$

where SA is the outer diameter of the yoke portion along the vertical axis, LA is the outer diameter of the yoke portion along the horizontal axis, and DA is the maximum outer diameter of the yoke portion.

Also, as shown in FIG. 4, assume that the outline of the yoke portion having a section perpendicular to the tube axis at the deflection reference point 25 is a substantial rectangle not protruded toward the tube axis Z. The outline of this rectangle can be approximated by an arc having a radius of curvature Rv with the center on the vertical axis, an arc having a radius of curvature Rh with the center on the horizontal axis and an arc having a radius of curvature Rd with the center on the straight line connecting a point associated with the maximum outer diameter and the tube axis. At the same time, the sectional shape of the yoke portion is configured to assure Rh or Rv of 900 mm or less. Thus, a sufficient bulb strength can be secured.

The above-mentioned fact is applicable also to the case where the aspect ratio of the phosphor screen is 4:3, 16:9 or 3:4.

Also, taking the distribution of the sectional area of the winding constituting the deflection coils into consideration, in order to further reduce the deflection power, it has been found that the rectangularity index X of the core portion 24 of the deflection yoke 20 is effectively set to about 0.90 or less.

As shown in FIG. 9, the horizontal deflection coil 22 of the deflection yoke 20 is formed by winding a plurality of turns of the loops including parallel portions 22C extending along the both sides of the tube axis Z and crossover portions 22A, 22B connecting the parallel portions 22C. These crossover portions 22A, 22B cross the tube axis Z in a substantially arcuate curve about the tube axis Z.

The bend portion 22*a* on the screen side is formed by stacking of the crossover portions 22A of the loops in the direction away from the tube axis. In other words, the winding constituting the crossover portion 22A is wound in the direction away from the tube axis Z.

The bendless portion 22*b* on the neck side is formed by arranging in the crossover portions 22B of the loops in the direction along the tube axis Z. In other words, the winding constituting the crossover portion 22B is wound in the direction along the tube axis Z. Preferably, the bendless portion 22*b* is configured of a single winding layer along the outer surface of the neck portion N.

Figure 7A:
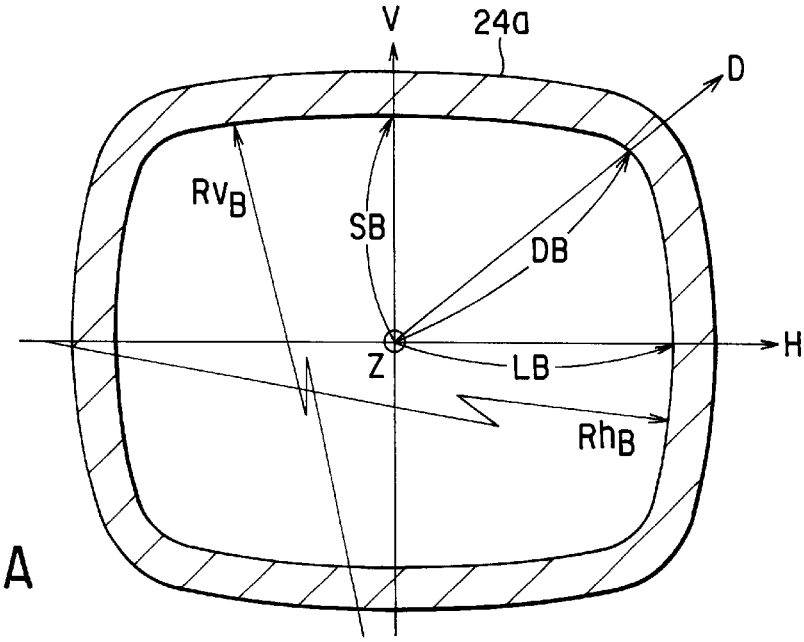
FIG. 7A is a diagram showing the shape of the end portion, nearer to the screen perpendicular to the tube axis, of the core portion of the deflection yoke of FIG. 3.
Figure 7B:
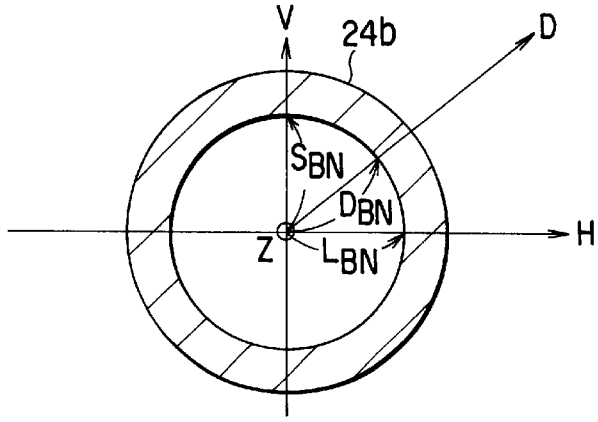
FIG. 7B is a diagram showing the shape of the end portion of the core portion nearer to the neck portion perpendicular to the tube axis.

FIGS. 7A and 7B show the shape of an end of the core portion 24 of the deflection yoke 20. The distance from the tube axis Z to the inner surface of the core portion 24 is defined as the inner diameter, the inner diameter along the horizontal axis is designated by LB, the inner diameter along the vertical axis is designated by SB, and the maximum inner diameter of the core portion 24 is defined as DB.

Specifically, the end portion 24*b* on the neck portion side of the core portion 24, as shown in FIG. 7B, is formed in a circle in a manner following the outer diameter of the neck portion. The section of the core portion 24 perpendicular to the tube axis Z between the end portion 24*b* and the boundary 14*b* is a circle of substantially the same shape as the outline of the neck portion. A difference between (a) the inner diameter LB along the horizontal axis and the inner diameter SB along the vertical axis and (b) the maximum inner diameter DB is made in the range from the boundary 14*b* to the screen along the tube axis Z. Specifically, the difference progressively increase along the tube axis Z toward the screen away from the boundary 14*b*. As a result, the section perpendicular to the tube axis Z, of the core portion between the boundary 14*b* and the screen is a non-circle, that is, a rectangle having a maximum inner diameter DB larger than LB and SB. The end portion 24*a* on the screen side of the core portion 24 is formed to have a rectangular inner profile in conformance with the outline of the pyramidal yoke portion, as shown in FIG. 7A. In the example shown in FIG. 7A, the aspect ratio of the inner profile substantially coincides with the aspect ratio of the screen and is M:N=4:3, for example.

Specifically, the outline of the section of the neck portion perpendicular to the tube axis is a circle. The outline of the section of the yoke portion perpendicular to the tube axis Z changes to a non-circle starting from the boundary 14*b* with the neck portion toward the faceplate. The deflection yoke mounted on the outer surface of the neck portion and the yoke portion having the above-mentioned outline has a core portion of a shape defined below. Specifically, at least a section of the core portion perpendicular to the tube axis, on the neck portion side of the boundary 14*b* between the neck portion and the yoke portion, is a circle substantially similar to the outline of the neck portion. Also, at least a section of the core portion perpendicular to the tube axis, on the screen side of the boundary 14*b*, is a non-circle having a maximum inner diameter in a direction other than along the vertical axis and the horizontal axis. This section on the screen side of the boundary 14*b* is a rectangle in the case where the aspect ratio of the substantially rectangular phosphor screen is M:N. Assume that the aspect ratio of the inner diameters of the particular section of the core and the aspect ratio of the phosphor screen are substantially coincident with each other and hence that the aspect ratio of the inner diameters of the core portion is M:N. Also, let SB be the inner diameter of the core portion along the vertical axis, LB the inner diameter of the core portion along the horizontal axis and DB the maximum inner diameter of the core portion. Then, the section involved has a shape satisfying the relation $$(M+N)/2*(M^2+N^2)^{1/2}<(SB+LB)/(2DB)\leqq 0.90$$

Also, at the end portion 24*b* on the neck portion N side of the core portion, let SBN be the inner diameter of the core portion along the vertical axis, LBN the inner diameter along the horizontal axis and DBN the maximum inner diameter of the core portion. Then, the conditions shown below are desirably satisfied.

$$0.95 \leqq SBN/DBN \leqq 1.05$$

$$0.95 \leqq LBN/DBN \leqq 1.05$$

Figure 10A:
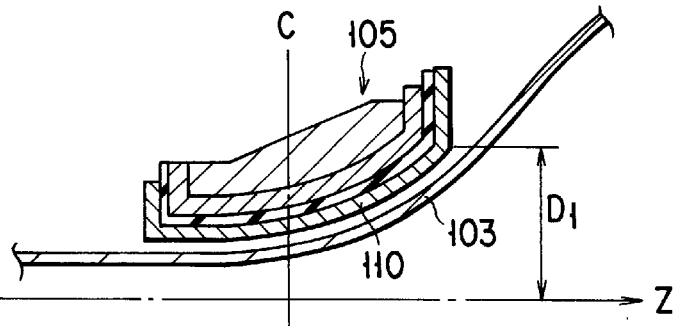
FIG. 10A (PRIOR ART)
FIG. 10A is a diagram schematically showing a sectional shape of the yoke portion and the deflection yoke of a conventional cathode ray tube apparatus.
Figure 10B:
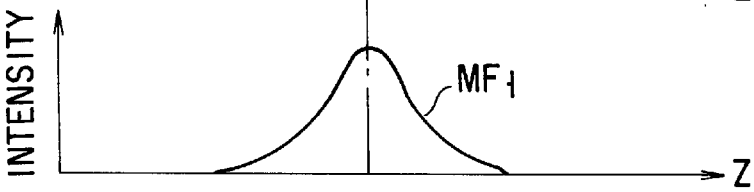
FIG. 10B (PRIOR ART)
FIG. 10B is a diagram showing the distribution of the horizontal deflection magnetic field formed by the deflection yoke shown in FIG. 10A.
Figure 10C:
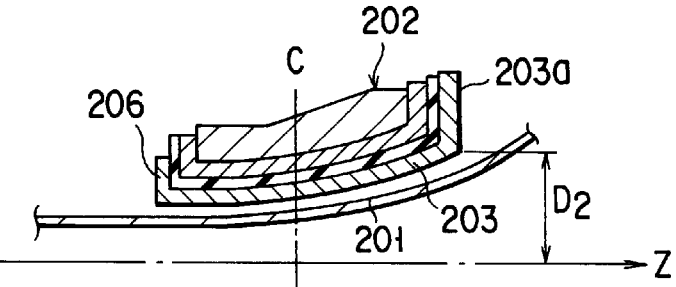
FIG. 10C (PRIOR ART)
FIG. 10C is a diagram schematically showing the sectional shape of the yoke portion and the deflection yoke of another conventional cathode ray tube apparatus.
Figure 10D:
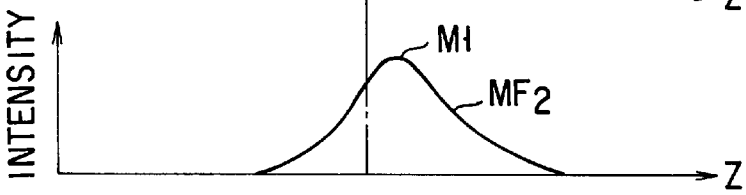
FIG. 10D (PRIOR ART)
FIG. 10D is a diagram showing the distribution of the horizontal deflection magnetic field formed by the deflection yoke shown in FIG. 10C.
Figure 10E:
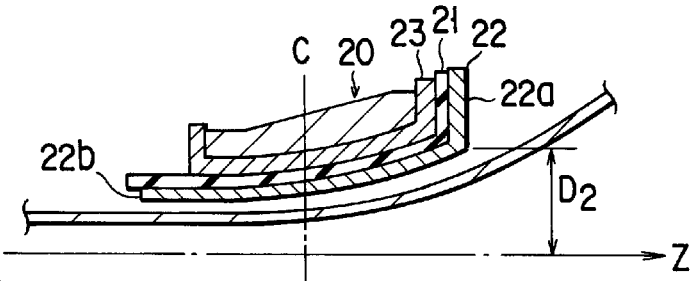
FIG. 10E is a diagram schematically showing a sectional shape of the yoke portion and the deflection yoke of the cathode ray tube apparatus according to this invention.

In a cathode ray tube apparatus having this configuration, as shown in FIG. 10E, in order to reduce the magnetic field leaking toward the neck, the bendless configuration which the winding of the crossover portion 22B making up the horizontal deflection coil 22 is arranged in the direction along the tube axis is effective.

Figure 11:
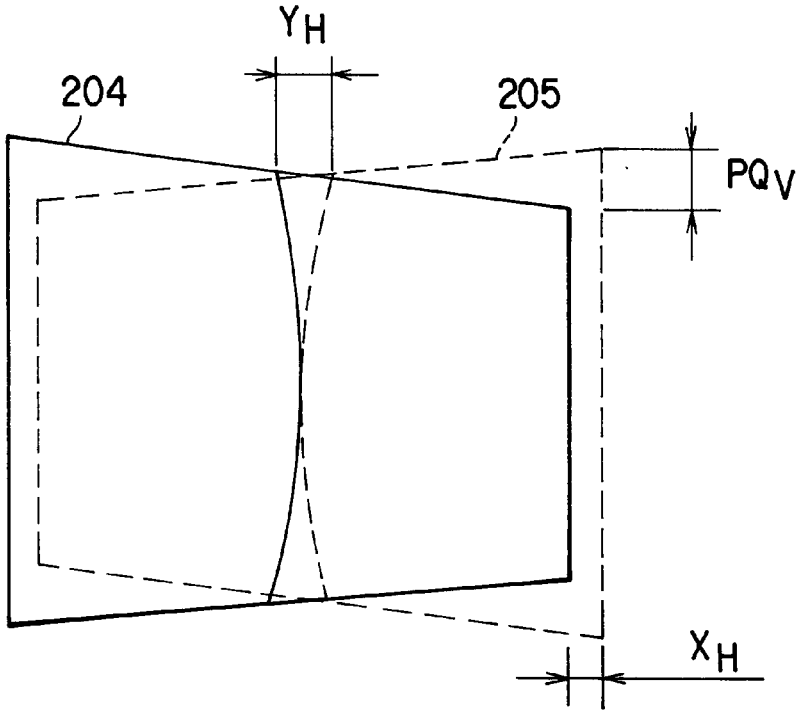
FIG. 11 is a diagram for explaining the trilemma indicating the degree of misconvergence.
Figure 10F:
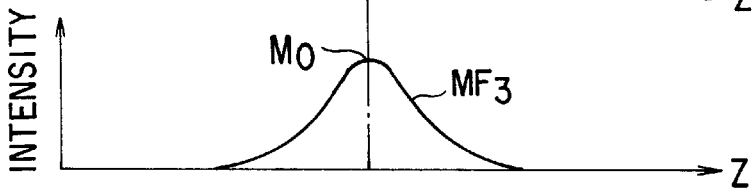
FIG. 10F is a diagram showing the distribution of the horizontal deflection magnetic field formed by the deflection yoke shown in FIG. 10E.

As a result, as shown in FIG. 10F, the deflection center MO of the horizontal deflection magnetic field distribution MF3 shifts toward the neck from the deflection center M1 of the horizontal deflection magnetic field distribution MF2 due to the horizontal deflection coil 203 of the bend-up structure shown in FIG. 10C. Thus, the positive trilemma described with reference to FIG. 11 is corrected in negative direction. In this way, it is possible to make the misconvergence approach zero infinitely. The deterioration of the convergence characteristic is thus prevented.

Also, the reduction in the leakage magnetic field toward the neck can improve the deflection efficiency and can reduce the deflection power as compared with the bend-up structure shown in FIG. 10C.

A preferred embodiment will be described below.

The basic structure is described above and will not be described in detail.

As shown in FIG. 1, the vacuum envelope 11 of the cathode ray tube apparatus 1 according to this embodiment comprises a glass faceplate P, a funnel portion F, a yoke portion Y and a neck portion N.

The deflection yoke 20 is mounted on the yoke portion Y in such a position that the end portion 20*a* on the screen side thereof is located in the neighborhood of the boundary 14*a*. This deflection yoke 20 includes a horizontal deflection coil 22 and a vertical deflection coil 23 insulated from each other by a horn-type separator 21. These deflection coils are of saddle type and constitute what are called the saddle-saddle type deflection coils. Specifically, the horizontal deflection coil 23 is fixed in grooves formed in the inner wall of the separator 21. The vertical deflection coil 23 is fixed on the outer wall of the separator 21. The cylindrical core portion 24 formed of a magnetic material of a high permeability is fixed around the outer periphery of the vertical deflection coil 23.

As shown in FIG. 9, the horizontal deflection coil 22 is formed by winding 30 to 40 turns of the loops including the crossover portions 22A, 22B connecting the parallel portions 22C extending along the both sides of the tube axis Z. This horizontal deflection coil 22 forms a magnetic field of pin-cushion type in the direction along the vertical axis V.

The bend portion 22*a* on the screen side is formed by stacking the crossover portions 22A of the loop-like windings from the outer surface of the yoke portion Y in the direction away from the tube axis Z. The bendless portion 22*b* on the neck side is preferably formed of a single winding layer which formed by arranging in the crossover portions 22B of the loop-like windings in the direction along the tube axis Z.

The core portion 24 has an inner surface similarly shaped to the outline of the pyramidal yoke portion 14. The inner profile of the section of this core portion 24 perpendicular to the tube axis Z is a substantial circle at the end portion 24*b* on the neck portion side thereof, as shown in FIG. 7B, and a non-circle, that is, a substantial rectangle at the end portion 24*a* on the screen side, as shown in FIG. 7A. The section of the core portion 24 perpendicular to the tube axis Z changes from a circle to a non-circle progressively from the end portion 24*b* on the neck portion side thereof toward the end portion 24*a* on the screen side thereof, and assumes a maximum diameter at the end portion 24*a* on the screen side thereof.

Figure 8:
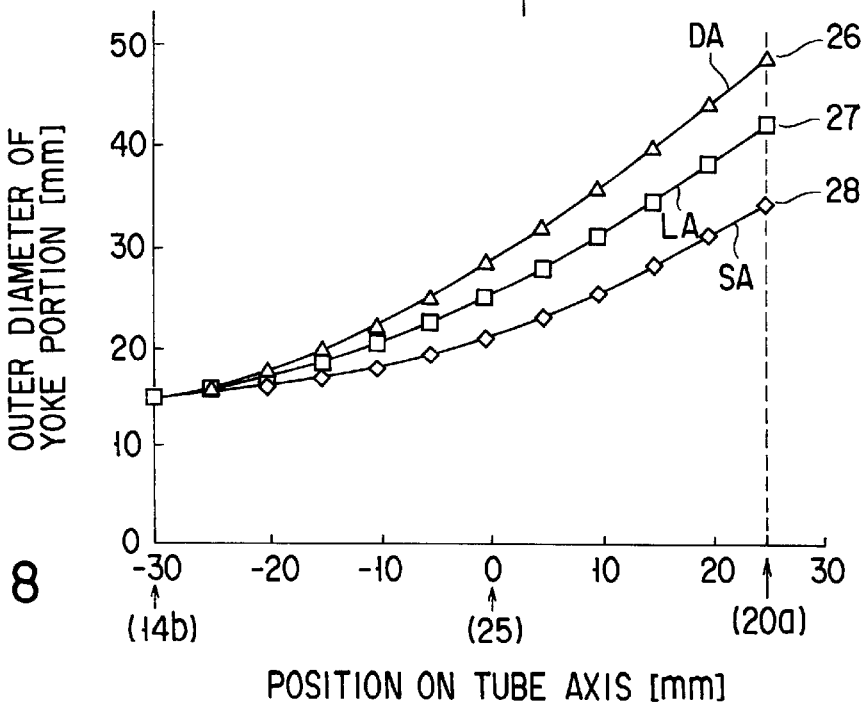
FIG. 8 is a diagram showing the relation between the position on the tube axis and the maximum outer diameter, the outer diameter along the horizontal direction and the outer diameter along the vertical direction of the yoke portion of the cathode ray tube apparatus according to an embodiment of the invention.

More specifically, the yoke portion Y has a vertical section having the length as shown in FIG. 8 at a position on the tube axis Z. In FIG. 8, the abscissa represents the position of the end portion 20*a* of the deflection yoke 20 on the screen side of the boundary 14*b* between the neck portion N and the yoke portion Y, and the ordinate represents the outer diameter of the yoke portion. In this case, it is assumed that the deflection reference point 25 is 0, the screen side is positive and that the neck side is negative. A curve 26 represents the outer diameter DA along the diagonal, a curve 27 the outer diameter LA along the horizontal axis, and a curve 28 the outer diameter SA along the vertical axis.

As shown by these curves 26 to 28, the outer diameters DA, LA and SA along the diagonal, the horizontal axis and the vertical axis, respectively, are equal to each other in the neighborhood of the boundary 14*b*, and are given as $$SA/DA = LA/DA = 1$$

The outer diameters LA and SA along the horizontal axis and the vertical axis, respectively, decrease relative to the outer diameter DA along the diagonal direction progressively toward the screen. Specifically, the sectional shape of the yoke portion Y in the neighborhood of the boundary 14*b* is a circle of substantially the same diameter as the neck portion N. Also, the sectional shape of the yoke portion Y on the screen side thereof is a substantial rectangle having the maximum diameter along the diagonals.

In this case, the aspect ratio M:N of the phosphor screen 17 is 4:3. Further, the sectional shape of the yoke portion Y at the deflection reference point 25 is given as $$(LA+SA)/(2DA) = 0.83$$

where DA=30.2 m, LA=27.5 mm and SA=22.5 mm. Also, the ratio of curvature of the outer surface in the section of the yoke portion Y at the deflection reference point 25 are $$Rh = 113 \text{ mm}, Rv = 312 \text{ mm}, \text{ and } Rd = 8.8 \text{ mm}$$

Under this condition, the maximum vacuum stress of the yoke portion Y is 1170 psi, which is a sufficient value as the bulb strength of a vacuum envelope.

The core portion 24 of the deflection yoke 20 mounted on the outer surface of the envelope 11 having this outline has the following shape.

Specifically, between the neck side end portion 24*b* of the core portion 24 and the boundary 14*b*, the section of the core portion 24 perpendicular to the tube axis, as shown in FIG. 7B, is a circle substantially matching the outline of the neck portion N. For this neck side end portion 24*b*, the inner diameters along the vertical axis, the horizontal axis and the diagonal axis are substantially same and given as $$SBN/DBN \approx LBN/DBN \approx 1$$

The inner diameters LB and SB along the horizontal and vertical axes decrease relatively to the inner diameter DB along the diagonal axis progressively toward the screen. The section of the core portion perpendicular to the tube axis is a substantial rectangle having a maximum diameter along the diagonal axis.

As shown in FIG. 7A, the section at the end portion 24*a* on the screen side is given as $$(LB+SB)/(2DB)=0.88$$

where DB=48.2 mm, LB=44.7 mm and SB=39.8 mm.

With a cathode ray tube apparatus having this structure, the deflection power could be reduced by about 18% as compared with the cathode ray tube apparatus having a conical yoke portion.

Also, as shown in FIG. 9, the end portion on the neck side of the horizontal deflection coil 22 arranged along the outer surface of the envelope 11 has a bendless structure, so that the leakage magnetic field toward the neck portion can be reduced. As a result, as shown in FIG. 10F, the deflection center MO of the horizontal deflection magnetic field distribution MF3 can be shifted toward the neck from the deflection center M1 of the horizontal deflection magnetic field distribution MF2 due to the horizontal deflection coil 203 having the bend-up structure shown in FIG. 10D. Thus, the positive trilemma described with reference to FIG. 11 can be corrected in negative direction so that the misconvergence can be reduced infinitely toward zero. In this way, the deterioration of the convergence characteristic can be prevented.

As described above according to this invention, the deflection power can be reduced while securing a sufficient bulb strength. At the same time, the deterioration of the convergence characteristic is prevented, thereby producing a cathode ray tube apparatus and a deflection yoke used with the cathode ray tube apparatus which can meet the requirements for both high brightness and high resolution.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube apparatus comprising:

a vacuum envelope including a faceplate having on the inner surface thereof a substantially rectangular phosphor screen having an aspect ratio M:N between the length along a horizontal axis perpendicular to a tube axis and the length along a vertical axis perpendicular to the tube axis and the horizotal axis, a cylindrical neck portion having an electron gun assembly built therein for emitting electron beams in the direction along the tube axis, a funnel portion for connecting said faceplate and said neck portion, and a yoke portion of which a section perpendicular to the tube axis on the neck portion side of the funnel portion changes in shape from a circle of the same diameter as the neck portion to a non-circle having a maximum diameter in other than the directions along the horizontal axis and the vertical axis; and a deflection yoke mounted on the outer surface of the vacuum envelope and extending from said neck portion to the yoke portion for forming a deflection magnetic field for deflecting the electron beams;

wherein at least one section of said yoke portion perpendicular to said tube axis is a non-circle having a maximum outer diameter in a direction other than along said vertical axis and said horizontal axis, the outer diameter of said yoke portion being the distance between said tube axis and the outer surface of said yoke portion;

wherein said deflection yoke includes a cylindrical core portion formed of a magnetic material surrounding at least one of a horizontal deflection coil and a vertical deflection coil for forming said deflection magnetic field;

wherein at least one section of said core portion perpendicular to said axis is a non-circle having a maximum inner diameter in a direction other than along the vertical axis and the horizontal axis, the inner diameter of said core portion being the distance between said tube axis and the inner surface of said core portion;

wherein said horizontal deflection coil is formed of a loop-like winding including a pair of parallel portions extending along the both sides of said tube axis and crossover portions connecting said parallel portions, and the crossover portion nearer to the neck is formed of a winding arranged and wound in a direction along the tube axis.

2. A cathode ray tube apparatus according to claim 1, wherein said crossover portion of said horizontal deflection coil nearer to said neck is formed of a single winding layer along the outer surface of said neck portion without overlapping away from the tube axis.

3. A cathode ray tube apparatus according to claim 1, wherein at least one section of said yoke portion perpendicular to said tube axis holds the relation $$(M+N)/(2*(M^2+N^2)^{1/2}<(SA+LA)/(2DA)\leqq 0.86$$

where SA is the outer diameter along said vertical axis, LA is the outer diameter along the horizontal axis and DA is the maximum outer diameter.

4. A cathode ray tube apparatus according to claim 1, wherein at least one section of said core portion perpendicular to said tube axis holds the relation $$(M+N)/(2*(M^2+N^2)^{1/2}<(SB+LB)/(2DB)\leqq 0.90$$

where SB is the inner diameter along the vertical axis, LB the inner diameter along the horizontal axis, and DB the maximum inner diameter.

5. A cathode ray tube apparatus according to claim 1, wherein said horizontal deflection coil is formed substantially pyramidal.

6. A cathode ray tube apparatus according to claim 1, wherein said faceplate, when the outline thereof is approximated to a circle, has a radius of curvature at least twice the effective diagonal length of said phosphor screen.

* * * * *